US005584221A

United States Patent [19]

Petrantoni

[11] Patent Number: 5,584,221

[45] Date of Patent: Dec. 17, 1996

[54] SCREW INJECTOR MAGAZINE

[76] Inventor: Joseph Petrantoni, 19131 Huckavalle Rd., Odessa, Fla. 33556

[21] Appl. No.: 461,530

[22] Filed: Jun. 5, 1995

Related U.S. Application Data

[63] Continuation-in-part of Ser. No. 243,716, May 17, 1994, abandoned.

[51] Int. Cl.[6] ..... B25B 23/04

[52] U.S. Cl. ..... 81/434; 81/57.37; 206/344; 411/399

[58] Field of Search ..... 81/57.37, 434, 81/435; 206/344–347, 820; 411/399

[56] References Cited

U.S. PATENT DOCUMENTS

| | | | |
|---|---|---|---|
| 2,982,595 | 5/1961 | Rogers | 206/344 X |
| 3,903,784 | 9/1975 | Dekker | 411/399 |
| 4,367,837 | 1/1983 | Manino | 81/434 X |
| 4,667,545 | 5/1987 | Gould et al. | 81/434 X |
| 5,101,697 | 4/1992 | Fishback | 81/434 |
| 5,231,900 | 8/1993 | Deri | 81/434 X |
| 5,239,900 | 8/1993 | Macris | 81/435 |

*Primary Examiner*—James G. Smith
*Attorney, Agent, or Firm*—Stanley M. Miller

[57] ABSTRACT

A plurality of screws are held in a screw cartridge that is housed within a magazine, and in a first embodiment a spring urges the screws toward a screw injector chamber where they are driven into a substrate upon activation of a motor-operated screw gun. In the first embodiment, the screw cartridge is a blister pack that is split open by a bar positioned at the leading end of the cartridge. The magazine is positioned normal to a drill guide housing that includes a drill bit housing, a screw injector housing, and a screw discharge housing, and the leading end of the magazine is in open communication with the screw injector housing. The trailing end of the magazine is closed by a snap on end cap, and a spring is positioned between the end cap and a trailing end of the screw cartridge to urge the screws into the screw injector housing. Brackets are used to secure the attachment to the screw gun. The screw discharge chamber houses an expanding screw retention chuck that guides the screws as they enter the substrate. In a second embodiment, an indexing mechanism follows a closed loop path of travel with each plunge of the screw gun and delivers screws sequentially to the screw injector housing by sliding under a screw and raising it into the screw injector housing.

20 Claims, 8 Drawing Sheets

10
13
20
11
15
12
14
16
17
38
21
37
32
41A
43B
42
3
43A
41
44
43
42
43A
43
44
42
43A
43
44
43B
43
44
43B
46
22
30
28
27
26
25
24
23

66
60
64
62

60

60
9
9
8
8
7
7
30
33
32B
34
32A
32B
32
35
36

32B
36
10
34
32A
35
10

19
61
18
40
41
41A
42
43
43A
43B
44
46
20
32

25
27

SCREW INJECTOR MAGAZINE

This disclosure is a continuation-in-part of Ser. No. 08/243,716, filed May 17, 1994, by the same inventor, abandoned.

BACKGROUND OF THE INVENTION

1. Field of the Invention

This invention relates, generally, to tools for facilitating the rapid injection of screws. More particularly, it relates to a screw-holding magazine that is attached to a conventional screw gun.

2. Description of the Prior Art

Screws are commonly inserted into a substrate through use of screwdrivers. The most common screwdriver is, of course, a nonmotorized, handheld tool that engages the head of a screw; the tool is rotated by hand to drive the screw into the substrate. Screw guns are motorized, trigger-operated tools that perform the same task in a much faster manner.

There are numerous jobs that require the injection of large numbers of screws, one after the other. Since two hands are required to inject a screw, even when a screw gun is employed, the worker usually holds a supply of screws in his mouth. If overhead work is performed, this can be a dangerous practice because the worker might inadvertently swallow one or more screws when looking straight up.

There is a need, then, for an improved apparatus that would facilitate the rapid injection of a large number of screws in succession without requiring a worker to hold screws in unsafe ways.

However, in view of the art at the time the present invention was made, it was not obvious to those of ordinary skill how such a tool could be provided.

SUMMARY OF THE INVENTION

The present invention includes a screw cartridge and a magazine for holding the cartridge which are attached to a conventional hand-held screw gun, drill, or other motor-operated device having a rotatable output shaft. In a first embodiment, the screw cartridge is preferably provided in the form of a plastic blister pack that sandwiches a plurality of laterally spaced apart screws between opposite sides of the pack. The mechanism of the first embodiment includes a means for splitting the opposite sides of the blister pack from one another to successively release screws therefrom as they are fed into a screw injector chamber. A bias means continually urges the screws into the injector chamber so that a new screw enters the chamber as soon as each screw is injected into a substrate.

More particularly, the novel attachment means is attached to a hand-held, motor-operated tool of the type having a rotatable output shaft as aforesaid, and includes a drill guide means disposed at a leading end of said tool in alignment with said rotatable output shaft. The drill guide means includes a driving bit housing, a screw injector chamber, and a discharge chamber. A driving bit is disposed within said driving bit housing of said drill guide means, said driving bit being engageable and rotatable by said output shaft. A magazine is secured to said drill guide means, said magazine being of hollow, elongate construction, said magazine being disposed normal to said drill guide means and having an open leading end disposed in open communication to said screw injector chamber of said drill guide means. A screw cartridge of elongate construction is positioned within said magazine, said screw cartridge housing a plurality of laterally disposed screws. A bias means is provided for urging said screw cartridge toward said screw injector chamber. The screw cartridge is formed of two parts that house said screws between them. A cartridge opening means is provided for opening a leading end of said screw cartridge as said bias means urges said screw cartridge toward said screw injector chamber.

In a second embodiment, the screws are held in single file, vertically stacked relation to one another. Instead of a bias means that urges them toward the screw injector housing, the screws are lifted into said housing one at a time by a split carrier means. The split or longitudinally bifurcated carrier means follows a path of travel consisting of four strokes.

The first stroke, performed after a screw has been driven into a substrate, is in a downward and slightly rearward direction relative to the position of the screw that has just been driven; the distance of downward travel is substantially equal to the vertical space occupied by a screw in the magazine, i.e., the downward travel is of sufficient extent to position the split carrier below the next screw to be delivered to the screw injector housing.

The second stroke is a rearward stroke; the split carrier travels sufficiently far rearwardly to position itself below the next screw to be delivered to the screw injector housing.

The third stroke is slightly rearward and upward; the upward extent is the same as the downward extent of the first stroke so that the screw is lifted to the screw injector housing.

The fourth stroke is a forward stroke that returns the split carrier to its initial position while the screw gun mechanism performs driving of the screw into the substrate, i.e., the forward travel of the split carrier does not drive the screw into the substrate.

The above-described travel of the split carrier is controlled by a pair of plunger plates that have a trailing end slideably attached to the base of the screw gun. The oscillation of the gun toward the substrate and away from the substrate as successive screws are driven into said substrate is harnessed by said plunger plates to cause the split carrier to undergo said path of travel.

More particularly, each half of the split carrier is engaged by a set of cam follower pins that extend transversely therefrom. Specifically, a first pin engages an outboard side of a first half of the split carrier at a leading end of said first half, and a second pin engages an outboard side of a second half of said split carrier at its leading end. A third pin engages the outboard side of the first half of the split carrier at a trailing end of the first half and a fourth pin engages the outboard side of the second half of the split carrier at the trailing end of the second half.

The first and second leading pins are constrained to follow a first and second closed loop groove formed in the leading end of first and second stationary plates disposed on opposite sides of the split carrier. The third and fourth trailing pins are constrained to follow a third and fourth closed loop groove formed in said first and second stationary plates formed in the trailing end of said first and second stationary plates.

The first and second plunger plates are slideably mounted with respect to said first and second stationary plates, respectively, so that as the screw gun is oscillated rearwardly and forwardly as screws are sequentially driven into a substrate, the plunger plates oscillate rearwardly and forwardly as well, with some play being introduced into said oscillation by slots formed in the trailing end of each plunger plate because the length of the gun's screwdriving stroke exceeds the length of the stroke of the split carrier.

The first and second plunger plates are positioned inwardly of the first and second stationary plates, respectively, and said cam follower pins extend through arcuate openings formed in said plunger plates so that reciprocation of said plunger plates carries said pins around the respective closed loop paths of travel. The arcuate openings enable the pins to travel upwardly and downwardly along their respective paths of travel.

Suitable bias means are employed to urge the cam follower pins upwardly when they are undergoing downward travel, and downwardly when they are undergoing upward travel; such bias means therefore urge said pins to their positions of repose so that they traverse their respective paths of travel without becoming jammed.

In both embodiments, a bracket means secures said drill guide means and said magazine to said hand-held tool. Accordingly, activation of said hand-held tool imparts rotation to said drill bit means to drive a screw disposed in said screw injector chamber into a substrate, whereupon another screw is urged into said screw injector chamber of said drill guide means for driving into said substrate upon subsequent activation of said hand-held tool.

The primary object of this invention is to provide a screw injector that holds a large plurality of screws in a magazine so that they may be injected into a substrate in rapid succession to one another.

Another object is to provide a blister pack for holding a large plurality of screws.

Another object of the first embodiment is to provide a means for automatically opening said particular type of blister pack to release screws therefrom as they are fed into a screw injection chamber.

An important object of the second embodiment is to provide an indexing means for delivering screws disposed in vertical relation to one another to the screw injector housing in a way that reduces jamming of the screw gun so that work can be performed without interruption.

These and other important objects, advantages, and features of the invention will become apparent as this description proceeds.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
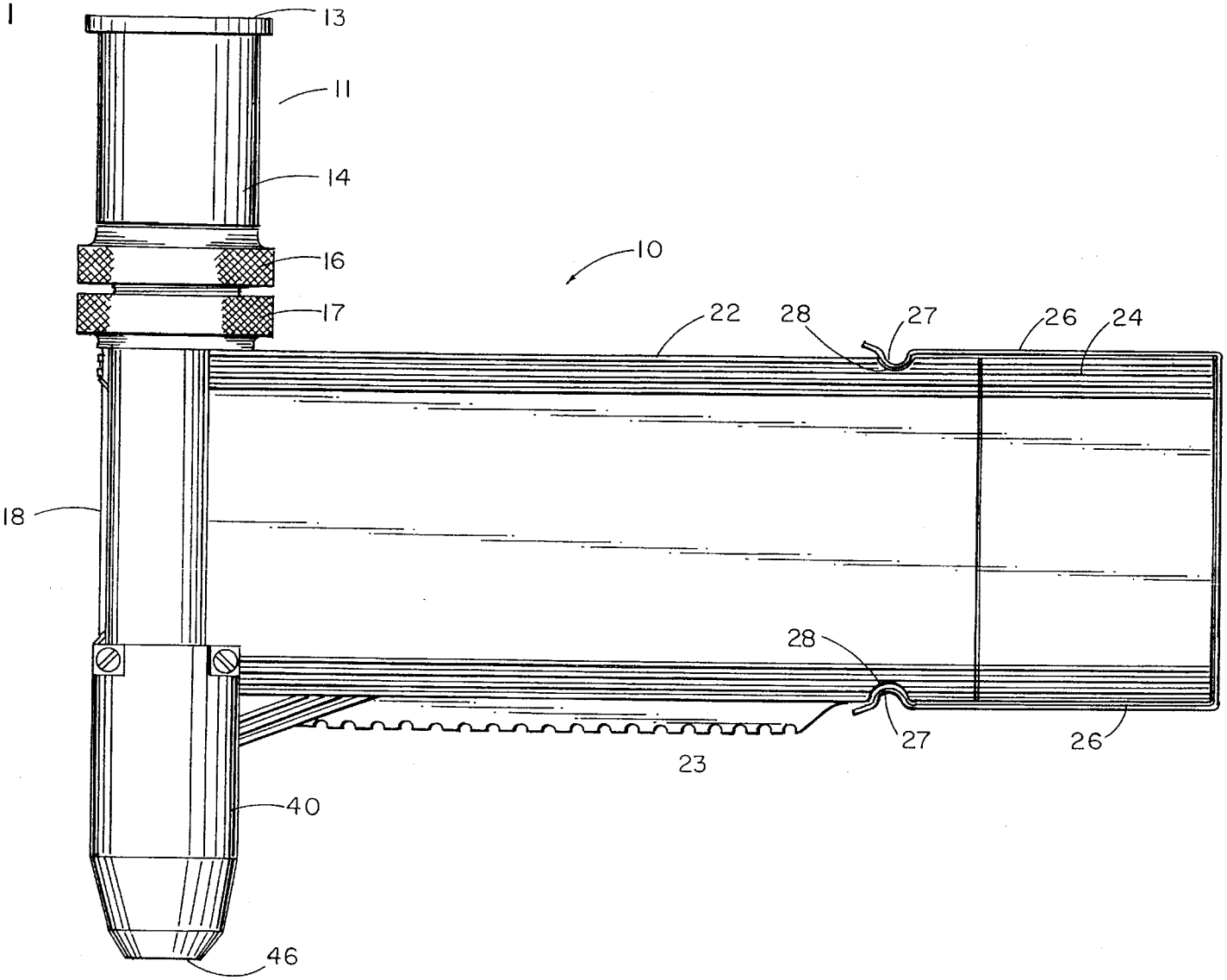
FIG. 1 is a side elevational view of an illustrative embodiment of the invention.
Figures 2, 3:
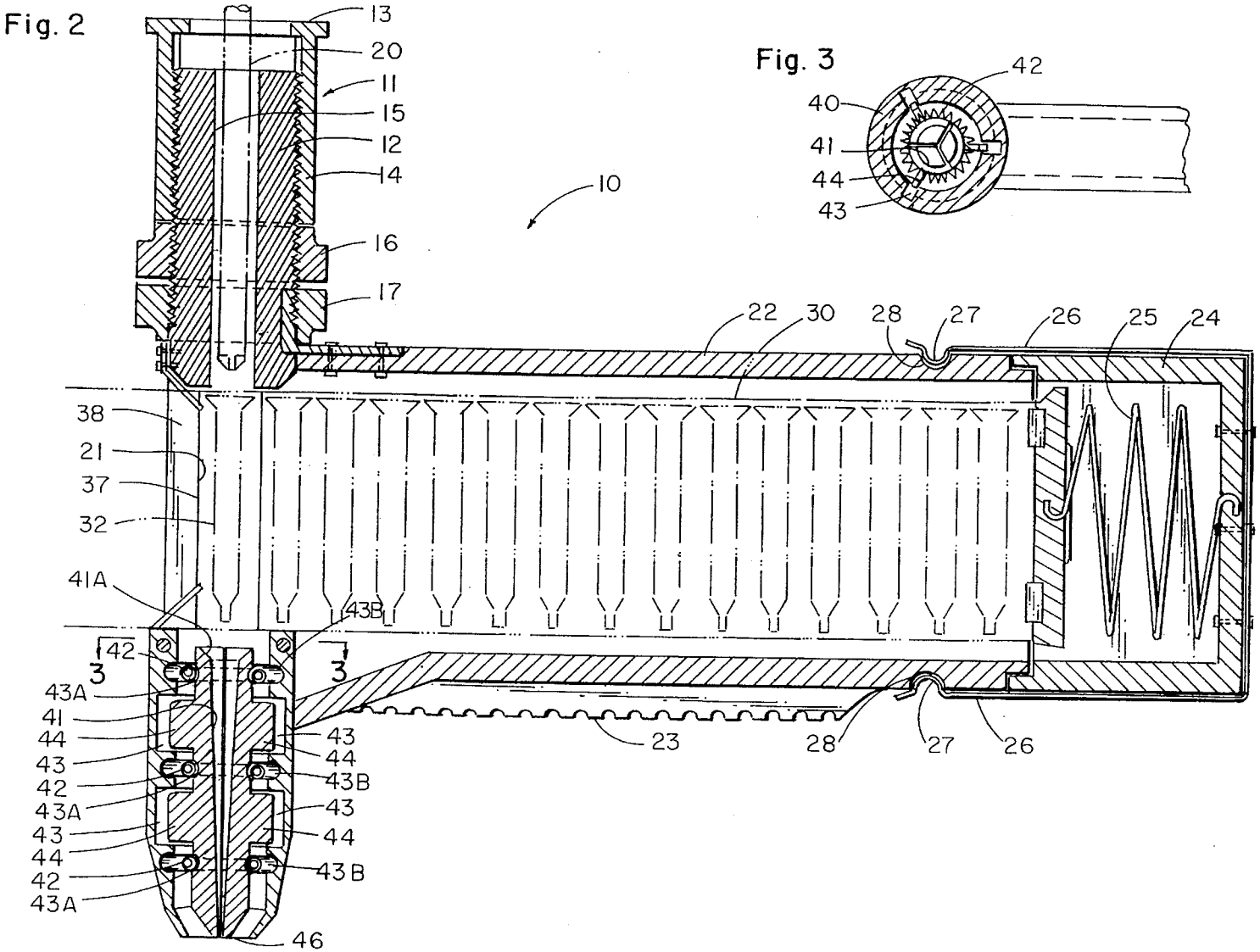
FIG. 2 is a longitudinal sectional view thereof.
FIG. 3 is a sectional view taken along line 3—3 in FIG. 2.

Referring now to FIGS. 1 and 2, it will there be seen that an exemplary embodiment of the invention is denoted as a whole by the reference numeral 10. Attachment 10 includes a drill guide means 11 that includes a driving bit housing 12 (FIG. 2), a screw injector housing 18 including screw injector chamber 21, and a discharge housing 40 including discharge chamber 41.

Driving bit housing 12 is cylindrical and has external threads formed thereon for screw threadedly engaging internally threaded adjustment sleeve 14. Moreover, housing 12 is centrally bored as at 15; note that it accommodates driving bit 20. Locking nuts 16 and 17 control the adjustment of sleeve 14 and sleeve 14, in turn, determines the depth to which driving bit 20 may be driven. (The depth decreases as sleeve 14 moves upwardly in FIG. 2).

Adjustment of sleeve 14 enables the screw head to be driven beneath the surface of a substrate in applications where countersinking is called for, flush with the substrate when no countersinking is desired, or projecting upwardly therefrom if the screw is to be used to hang a picture or the like.

Magazine 22, which is permanently secured at its leading end to drill guide means 11, is hollow and houses blister pack cartridge 30; note that it is disposed normal to drill guide means 11 and that its leading end is disposed in open communication to screw injector chamber 21 of screw injector housing 18.

Spring-loaded end cap 24 closes the open trailing end of magazine 22 as shown. Specifically, a pair of externally mounted, flexible and resilient leaf springs 26 have detents 27 formed at their respective free ends, and said detents engage associated recesses 28 formed in magazine 22 near its trailing end to thereby provide a snap on closure means that can be easily removed when a new screw cartridge is to be inserted into the magazine through its open trailing end. A bias means 25, sandwiched between the trailing end of end cap 24 and push bar 29 at the trailing end of cartridge 30, urges said cartridge toward the leading end of the magazine. Screws that exit cartridge 30 in the manner hereinafter disclosed enter into screw injector chamber 21 which is in axial alignment with the central bore 15 formed in drill bit housing 12.

Ridges 23 are formed in the underside of magazine 30 to enhance its gripability.

Drill guide means 11 further includes discharge housing 40, shown at the lower left corner of FIG. 2, within which is formed discharge chamber 41 which is in axial alignment with and which receives each screw 32 as it is ejected from screw injector chamber 21 by drill bit 20.

Figures 18, 19, 20, 21, 22:
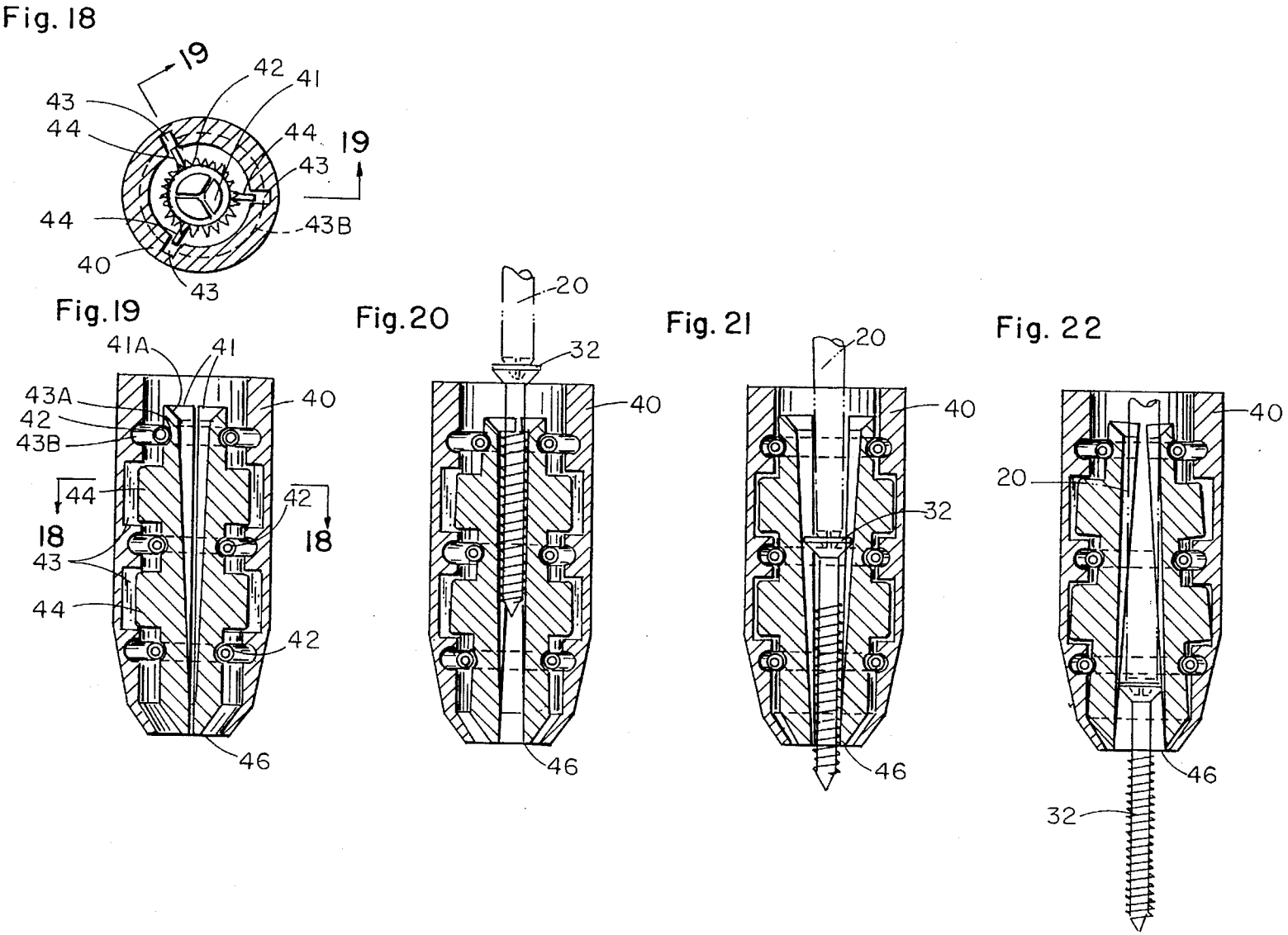
FIG. 18 is a sectional view of the novel expanding screw retention chuck taken along line 18—18 in FIG. 19.
FIG. 19 is a sectional view taken along line 19—19 in FIG. 18.
FIG. 20 is the first view of a three view animation showing the progress of a screw through the novel expanding screw retention chuck.
FIG. 21 is the second view of said three view animation.
FIG. 22 is the third view of said three view animation.

Discharge chamber 41 is defined by an expanding screw retention chuck. As depicted in FIG. 18, FIG. 19, and the animation of FIGS. 20–22, a three-sectioned, internally tapered chuck is centered in discharge housing 40 and is surrounded by a plurality (in this embodiment, three) of vertically spaced apart annular retention springs 42 which bias the three sections radially inwardly, i.e., toward one another. Discharge housing 40 is internally splined as at 43 to receive radially disposed fins 44, there being one fin 44 integral with each of the three internal chuck sections and there being one fin received within each spline as depicted. Annular coiled compression springs 42 ride within annular grooves 43A (FIG. 2) formed in said three part chuck. Moreover, there are three associated internal annular grooves or recesses 43B formed in housing 40 to provide space for radially outward expansion of the three piece chuck. As disclosed in FIGS. 2 and 19, the respective internal surfaces of the chuck sections collectively form conically tapered screw-receiving discharge chamber 41 having its narrow end at the bottom of the chuck and having its wide end at the top thereof, said wide end forming a frustoconical screw entry opening 41A. Thus, discharge housing 40 and its internal components act as a positioning chuck means to guide each screw 32, keeping each screw properly aligned when driven by bit 20 into the receptor material as depicted in the animation of FIGS. 20–22.

Figures 4, 5, 6, 7, 8, 9, 10, 11, 12, 13:
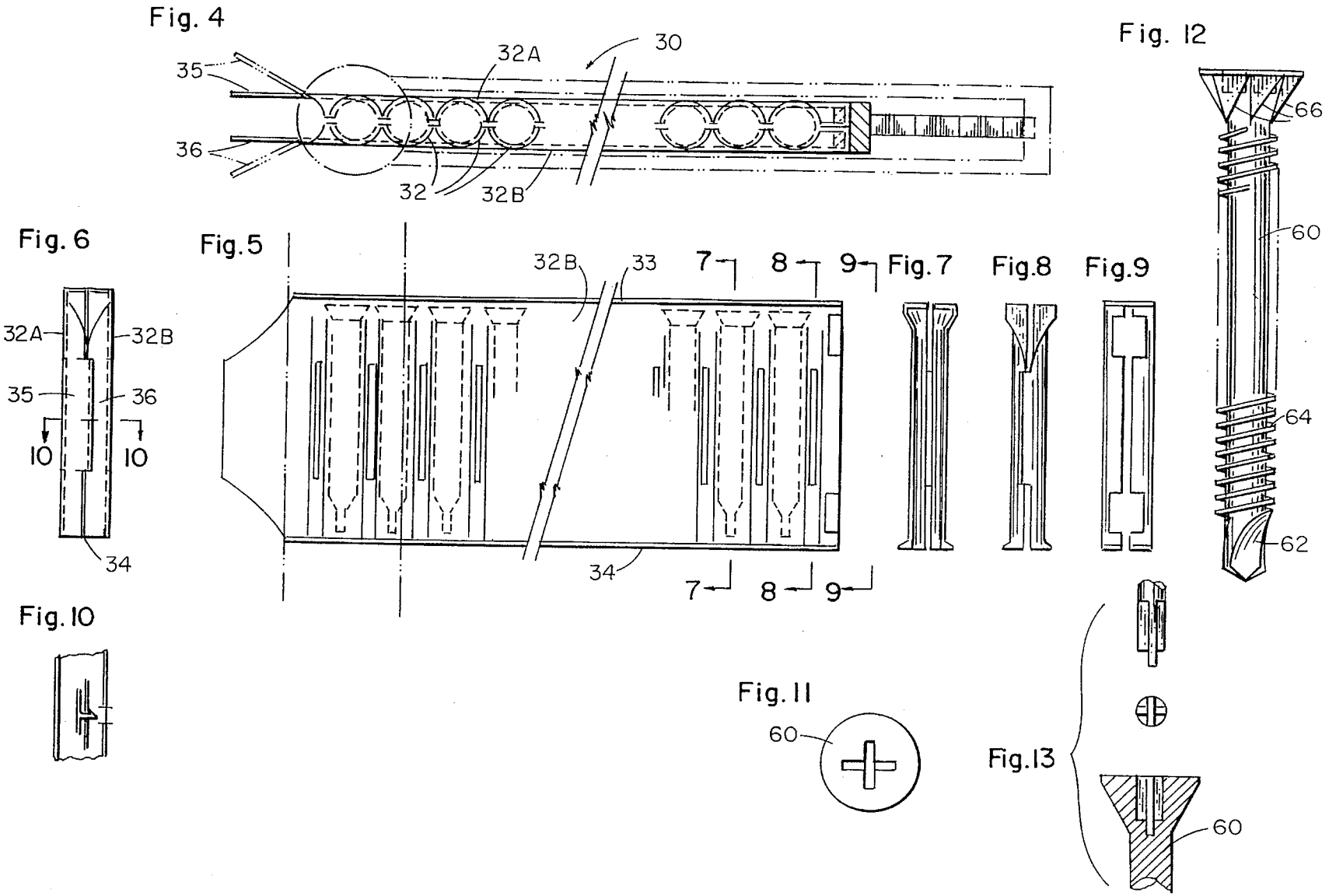
FIG. 4 is a top plan view of the screw-holding blister pack.
FIG. 5 is a side elevational view of the blister pack.
FIG. 6 is an end elevational view of the blister pack.
FIG. 7 is a sectional view taken along line 7—7 in FIG. 5.
FIG. 8 is a sectional view taken along line 8—8 in FIG. 5.
FIG. 9 is an end view taken along line 9—9 in FIG. 5.
FIG. 10 is a sectional view taken along line 10—10 in FIG. 6.
FIG. 11 is a top-plan view of the screw depicted in FIG. 12.
FIG. 12 is a side elevational view of a novel screw design.
FIG. 13 is an exploded view of a novel deep socket screw fastener and a unique driving bit used therewith.

Referring now to FIGS. 4 and 5, it will there be seen that screw cartridge 30 includes two parts 32A and 32B which are conjoined to one another at the respective tops and bottoms of said two pans, as at 33 and 34, by a suitable adhesive means. Each part 32A and 32B has a tab 35, 36 at a leading end thereof, said tabs being unsecured to one another. The tabs are separated from one another by spring bar 37 (FIG. 2) which is positioned in opening 38 (FIG. 2) adjacent screw injector chamber 21. Thus, as spring 25 urges screw cartridge 30 toward the leading end of the magazine, tabs 35 and 36 and hence the parts 32A and 32B of the cartridge are separated from one another, thereby sequentially releasing screws 32 therefrom so that they enter into the screw injector chamber 21.

FIGS. 7, 8, 9, and 10 depict structural aspects of the magazine along their associated section lines in FIG. 5.

The novel magazine works with conventional screws of any kind, and with unconventional screws as well. For example, this invention includes newly developed countersunk screw 60, depicted in FIGS. 11–13, that includes a drill tip 62, helical threads 64, and a plurality of frustoconical flutes 66 formed on the underside of its frustoconical head as shown. These flutes cut into the receptor material and pre-shape it to receive the countersunk head. FIG. 13 depicts a deep socket bit and screw slot shape that may be used with screw 60.

Referring now to FIGS. 14–17, it will there be seen how the novel apparatus may be attached by suitable bracket means to a convention screw gun or drill motor 70 (shown in phantom lines), or any other hand-held tool having a motor-operated rotatable output shaft. Note that drill bit housing 12, screw injector housing 18, and discharge housing 40 are all in axial alignment with one another and with the axis of rotation of the output shaft of the tool to which the novel assembly is attached.

Figures 14, 15, 16, 17:
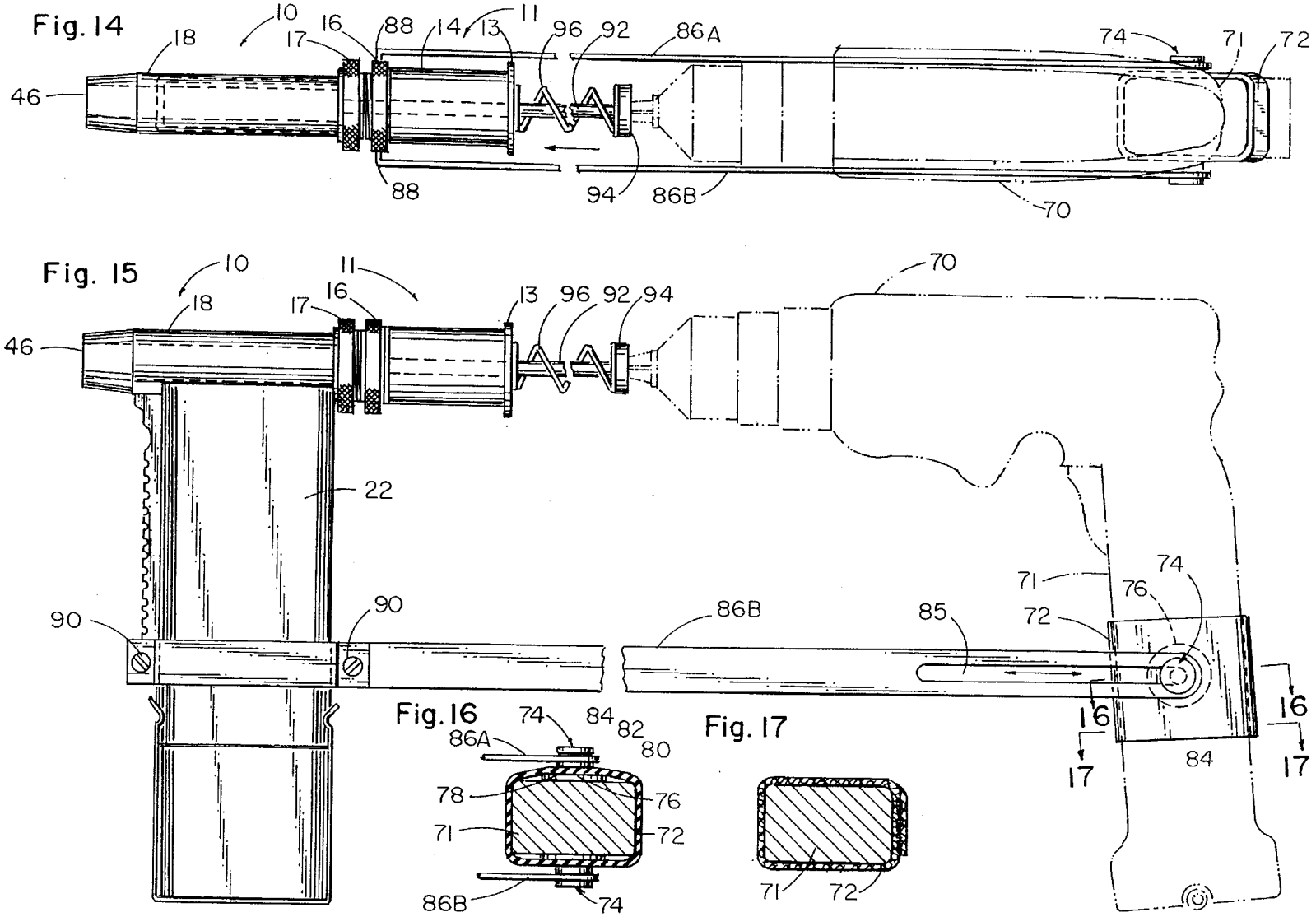
FIG. 14 is a top plan view of a cordless screw gun having the novel magazine attached thereto.
FIG. 15 is a side elevational view of the assembly depicted in FIG. 14.
FIG. 16 is a sectional view taken along line 16—16 in FIG. 15.
FIG. 17 is a sectional view taken along line 17—17 in FIG. 15.

Elastic ring 72, which includes a pair of ears 74, is slipped over handle 71 of screw gun 70 as depicted in FIG. 15. (As shown in FIG. 17, ring 72 may be provided in the form of a hook and loop fastener means). Each ear 74 includes an inner button 76, cylindrical shaft 78, a middle button 80, cylindrical shaft 82, and an outer button 84. Slotted arms 86A and 86B are slideably disposed on opposite sides of ring 72 between middle button 80 and outer button 84. Slots 85 ride upon shafts 82 of ears 74. Arms 86A and 86B extend from handle 71 toward magazine 22 as shown, and are bent inwardly as at 88 (at lock nut 16) and then continue around magazine 22 and are secured on the distal end thereof by screw and nut assemblies 90.

A specially designed screw driving bit 92 is fitted with a fixed ball bearing unit 94 and a compressible spring 96 is inserted between the bearing unit 94 and the annular flange 13 at the trailing end of guide 11. Bearing unit 94 prevents rotation of spring 96 when driving bit 92 rotates.

The device is used by gripping handle 71 with one hand and positioning nose 46 of chamber 40 against the receptor material where the first screw is to be injected. The nose is pressed against such receptor material with increasing pressure so that spring 96 is compressed and driving bit 92 is rotated; a screw is released from cartridge 30 and is driven into the receptor material. Compression spring 96 then returns assembly 10 to its starting position and the procedure is repeated.

Referring now to FIGS. 23–27, it will there be seen that a second embodiment includes an improved means for sequentially indexing the screws into the driving position.

Figures 23, 24, 25, 26, 27:
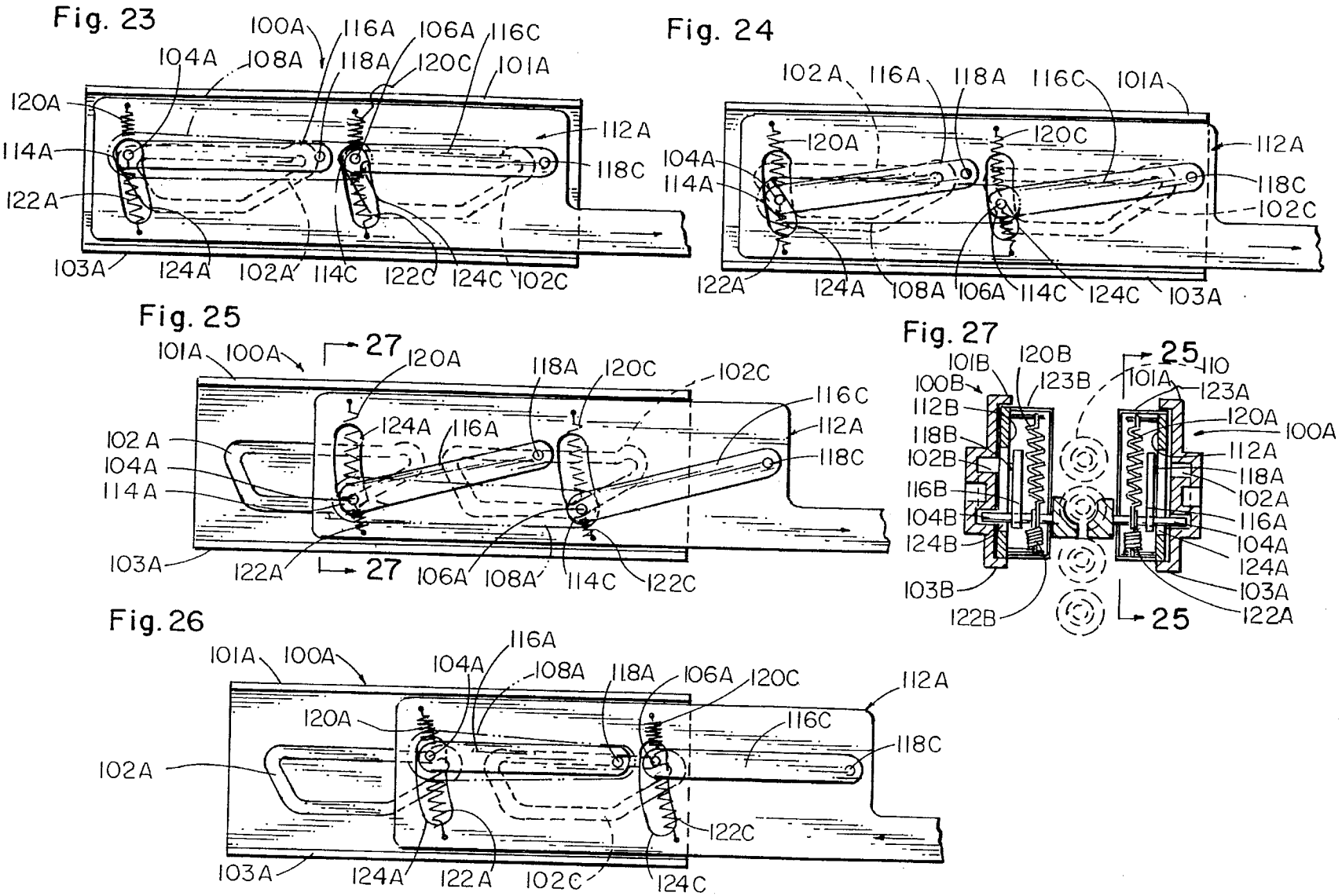
FIG. 23 is a longitudinal partial cross sectional view of an indexing mechanism in its plunged or driven position, said view being the first in a series of animations depicting travel of the split carrier.
FIG. 24 is a view like that of FIG. 23, but depicting the indexing mechanism in its partially retracted configuration.
FIG. 25 is a view like that of FIG. 24, but depicting the indexing mechanism still further retracted.
FIG. 26 is a view like that of FIG. 25, but depicting the indexing mechanism retracted still further so that it is in its lifted mode.
FIG. 27 is a sectional view taken along line 27—27 in FIG. 25.

Outer guide plates 100A, 100B, which are disposed in transversely spaced apart, parallel relation to one another as best understood in connection with FIG. 27, have formed therein stamped cam grooves 102A, 102B, respectively. As best understood in connection with FIG. 23, first and second leading cam follower pins or rollers 104A, 104B ride within first and second leading cam grooves 102A, 102B, and third and fourth trailing cam follower pins or rollers 106A, 106B ride within third and fourth trailing cam grooves 102C, 102D.

Cam follower pins 104A, 104B are connected to opposite outboard sides of a leading end of a split indexing carrier 108A, 108B (see FIG. 27), and cam follower pins 106A, 106B are connected to opposite outboard sides of a trailing end of said split indexing carrier.

Each guide plate 102A, 102B has inwardly turned flanges at its upper edge, denoted 101A, 101B, respectively, and inwardly turned flanges denoted 103A, 103B at its lower edge, respectively.

Flat plunger plate 112A is slidingly housed by flanges 101A, 103A, and flat plunger plate 112B is slidingly housed by flanges 101B, 103B; said plunger plates are thus slideably disposed with respect to the stationary guide plates.

Cam follower pins 104A, 104B extend through the respective leading ends 114A, 114B of leading first and second levers 116A, 116B. The trailing ends of said levers are respectively pivotally attached to plunger plates 112A, 112B as at 118A and 118B. Similarly, cam follower pins 106A, 106B extend through the respective leading ends 114C, 114D of third and fourth levers 116C, 116D. The trailing ends of levers 116C, 116D are pivotally attached to plunger plates 112A, 112B as at 118C, 118D.

The respective inner ends of first and second pins 104A, 104B are engaged by and biased upwardly by coil springs 120A, 120B and are engaged by and biased downwardly by coil springs 122A, 122B. Similarly, the respective inner ends of third and fourth pins 106A, 106B are engaged by and biased upwardly by coil springs 120C, 120D, and are engaged by and biased downwardly by coil springs 122C, 122D.

Closure plates 123A, 123B (FIG. 27) are positioned between their associated springs and blister packed screws 110 to prevent jamming of the mechanism. The opposite end of springs 120A, 122A are secured to closure plate 123A and the opposite ends of springs 120B, 122B are secured to closure plate 123B.

First and second arcuate slots 124A, 124B are formed in the respective leading ends of plunger plates 112A, 112B, and third and fourth arcuate slots 124C, 124D are formed about mid-length of said plates 112A, 112B. As plates 112A, 112B are retracted as depicted in animation in FIGS. 23–26, first and second cam follower pins 104A, 104B follow a closed loop path of travel defined by first and second slots 102A, 102B formed in first and second plates 100A, 100B, respectively, and third and fourth cam follower pins 106A, 106B follow a path of travel defined by third and fourth slots 102C, 102D. Thus, it should be understood that arcuate slots 124A, 124B enable levers 116A, 116B to pivot as cam follower pins 104A, 104B traverse their respective paths of travel, and that arcuate slots 124C, 124D perform the same function for levers 116C, 116D.

FIG. 23 depicts the end of one cycle of screw driving and the beginning of the next cycle. Upper springs 120A, 120B, 120C, and 120D are in repose, and lower springs 122A–D are expanded. Accordingly, said lower springs urge cam follower pins 104A, 104B, 106A, 106B downwardly relative to cam grooves 102A–D, as perhaps best understood by comparing FIGS. 23 and 24.

As plunger plates 112A, 112B retract, said cam follower pins reach the position depicted in FIG. 25; there it will be seen that upper springs 120A–D are now expanded and lower springs 122A–D are in repose. This causes cam follower pins 104A, 104B and 106A, 106B to be pulled upwardly to continue their respective paths of travel about cam grooves 102A–D.

Full retraction of plates 112A, 112B is depicted in FIG. 26. The cam follower pins have been pulled into the upper part of the cam grooves 102A–D, thereby assuring continued counterclockwise travel of said cam follower pins and return thereof to the FIG. 23 position.

The upward and forward travel of cam follower pins 104A–B and 106A–B lifts split carrier 108A–B and hence a screw 110 into position for being driven. The downward and rearward travel thereof as depicted in FIGS. 24 and 25 enables the split carrier 108A–B to engage the next screw for lifting. Thus, the cycle repeats with each plunge of the screw gun, lifting the blister pack one screw at a time into the driving position.

Figure 28:
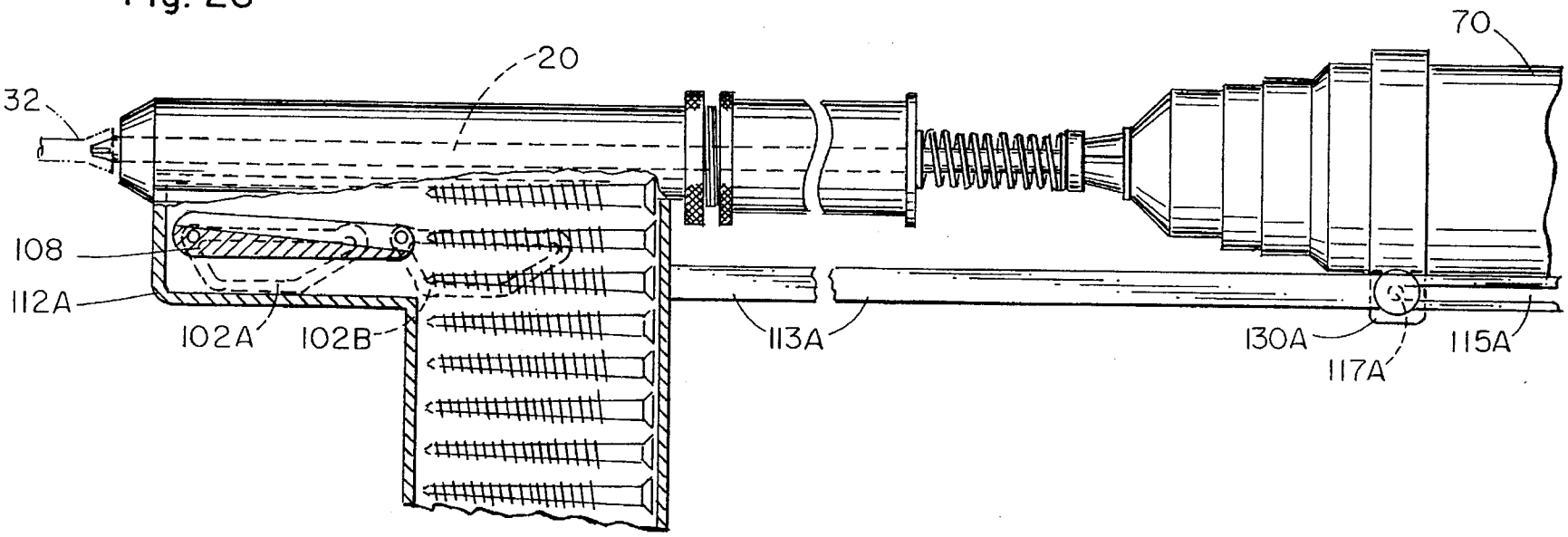
FIG. 28 is a view that superimposes the components depicted in FIGS. 23–26 upon the screw gun.

FIG. 28 should be construed in conjunction with FIG. 23; it depicts bit 20 in the fully plunged position, having driven a screw 32 into the receptor material. Carrier 108 is in its forward position, ready to be retracted as the screw gun is retracted.

First and second tail pieces 113A, 113B of first and second plunger plates 112A, 112B, respectively, are connected to first and second brackets 130A, 130B on opposite sides of screw gun 70 and said bracket is attached to a leading end of said screw gun. A slotted connection 115A, 115B is formed in the trailing end of each tail piece for sliding connection to brackets 130A, 130B to limit travel of the indexing mechanism. Such limiting is required because the range of the retracting action of the screw gun and bit 20 is greater than the distance needed to operate the indexing mechanism. Accordingly, slots 115A, 115B enable a screw 32 to move into the screw injector housing without colliding with bit 20.

Figure 29:
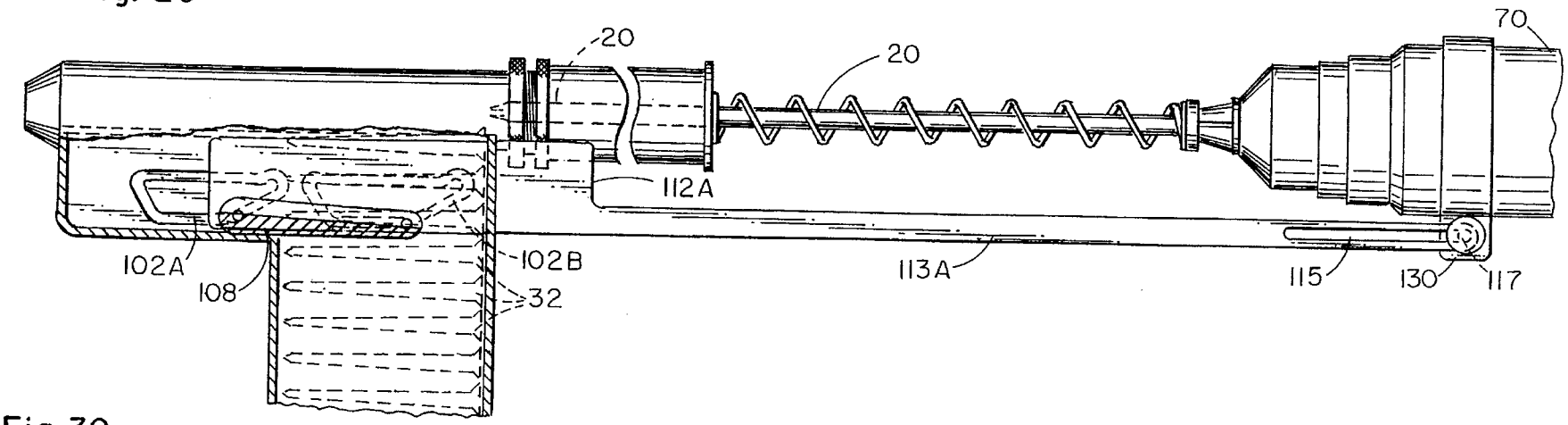
FIG. 29 is a view like that of FIG. 28, depicting a partial retraction of the screw gun coinciding with the position depicted in FIG. 25.
Figure 30:
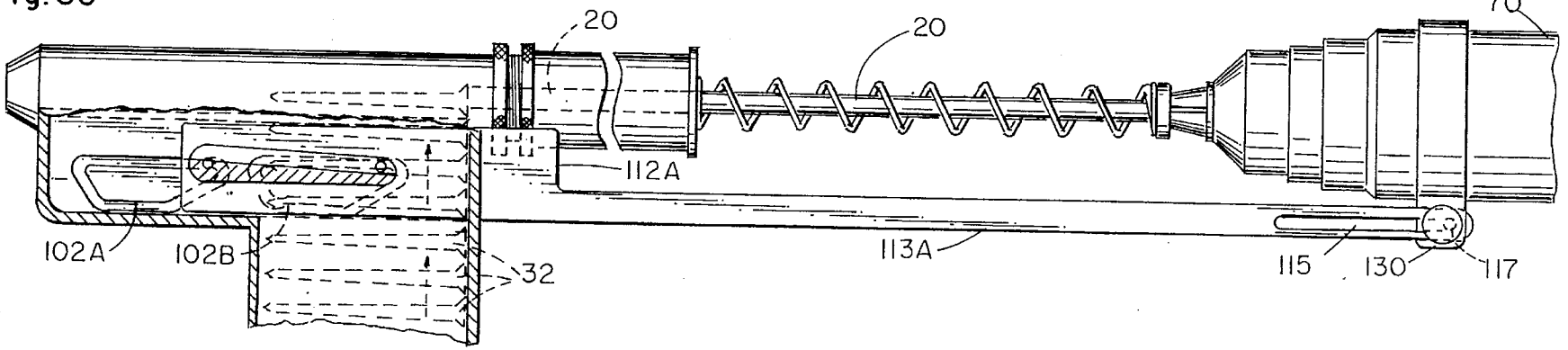
FIG. 30 is a view like that of FIG. 29, depicting a partial retraction of the screw gun coinciding with the position depicted in FIG. 26.

As depicted in FIG. 29, as bit 20 is fully retracted, carrier 108 slides under a screw 32 and raises the blister pack upward by a distance equal to the space occupied by one screw, thereby readying another screw to be driven. As depicted in FIG. 30, as the gun is plunged forwardly, the tip of bit 20 engages a screw 32 in said screw discharge housing.

A microswitch, not shown, may be employed to interrupt the trigger and the motor circuit, preventing the motor from operating until contact is made between bit 20 and a screw 32.

As the screw gun is plunged and the screw driven, connector pin 117 slides to the leading end of slot 115 as depicted in FIG. 28 and drives the indexing mechanism to its starting point, to commence a new cycle.

This arrangement of parts ensures smooth motion of carrier 108 as it slides between blister packed screws 110.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An attachment to a hand-held, motor-operated tool of the type having a rotatable output shaft, comprising:

a drill guide means disposed at a leading end of said tool in axial alignment with said rotatable output shaft;

said drill guide means including a driving bit housing, a screw injector housing, and a discharge housing;

a driving bit disposed within said driving bit housing of said drill guide means, said driving bit being engageable and rotatable by said output shaft;

a magazine secured to said drill guide means, said magazine being of hollow, elongate construction;

said magazine being disposed normal to said drill guide means and having an open leading end disposed in open communication to said screw injector housing;

a screw cartridge of elongate construction positioned within said magazine;

said screw cartridge housing a plurality of laterally spaced apart screws;

bias means for urging said screw cartridge toward said screw injector housing;

said screw cartridge formed of two conjoined parts that house said screws between them;

opening means for opening a leading end of said screw cartridge as said bias means urges said screw cartridge toward said screw injector housing;

bracket means for securing said drill guide means and said magazine to said hand-held tool;

each of said two parts of said screw cartridge having a tab at a leading end thereof, said two parts being releasably secured to one another, and said tabs being unsecured to one another;

said separating means including a bar member disposed within said screw injector, said screw injector housing in leading relation to said tabs for separating said tabs and hence said two parts of said screw cartridge from one another as said bias means urges said screw cartridge toward said screw injector housing;

whereby activation of said hand-held tool imparts rotation to said drill bit means to drive a screw disposed in said screw injector housing into a substrate, whereupon another screw is urged into said screw injector housing for driving into said substrate upon subsequent activation of said hand-held tool.

2. The attachment of claim 1, further comprising:

said magazine having an open trailing end;

closure means for releasably closing said open trailing end;

said closure means including a snap on cap;

said snap on cap having a pair of parallel leaf springs that releasably engage said trailing end of said magazine.

3. The attachment of claim 2, wherein said bias means for urging said screw cartridge toward said screw injector housing is disposed between a trailing end of said screw cartridge and said snap on cap.

4. The attachment of claim 3, further comprising a detent means disposed in said discharge chamber for maintaining alignment of each screw as it is driven from said screw injector housing through said discharge housing into said substrate.

5. The attachment of claim 1, wherein said driving bit housing includes a central bore for receiving said driving bit, wherein said driving bit housing is externally threaded, and wherein an internally threaded adjustable sleeve threadedly engages said external threads of said driving bit housing.

6. The attachment of claim 5, further comprising a pair of internally threaded lock nuts in axial alignment with said internally threaded adjustable sleeve, said lock nuts threadedly engaging said drill bit holder and locking said internally threaded adjustable sleeve into any preselected position of adjustment so that a penetration depth of a screw is adjustable by controlling a penetration depth of the drill bit, said penetration depth of said drill bit being controlled by adjustment of said internally threaded adjustable sleeve.

7. The attachment of claim 1, wherein said screw cartridge includes a plurality of countersunk screws, each of said countersunk screws having a frustoconical head and including a plurality of frustoconical flutes formed in an underside of said frustoconical head.

8. The attachment of claim 1, wherein said discharge housing includes an expanding screw retention chuck having plural chuck sections centered in said discharge housing.

9. The attachment of claim 8, further comprising a plurality of vertically spaced apart annular retention springs which bias the plural chuck sections radially inwardly toward one another.

10. The attachment of claim 9, wherein a radially disposed fin is formed in each chuck section of said plurality of chuck sections, and wherein said discharge housing is internally splined to receive said radially disposed fins, there being one fin received within each of said splines.

11. The attachment of claim 10, further comprising a plurality of annular grooves formed within said chuck, said annular retention springs being positioned within each of said annular grooves to urge said plural chuck sections radially inwardly toward one another.

12. The attachment of claim 11, further comprising a plurality of associated internal annular grooves formed in said discharge housing to provide space for radially outward expansion of the chuck within said discharge housing.

13. The attachment of claim 12, wherein each of said chuck sections have internal surfaces that are tapered to collectively form a conical screw-receiving bore having a narrow end at a bottom of said chuck and a frustoconical screw entry opening at a top end of said chuck.

14. An attachment to a hand-held, motor-operated screw gun of the type having a rotatable output shaft, comprising:

a drill guide means disposed at a leading end of said tool in axial alignment with said rotatable output shaft;

said drill guide means including a driving bit housing, a screw injector housing, and a discharge housing;

a driving bit disposed within said driving bit housing, said driving bit being engageable and rotatable by said output shaft;

a magazine secured to said drill guide means, said magazine being of hollow, elongate construction;

said magazine being disposed normal to said drill guide means and having an open leading end disposed in open communication to said screw injector housing;

a screw cartridge of elongate construction positioned within said magazine, said screw cartridge containing a plurality of vertically stacked screws therein;

an index means for sequentially delivering screws to said screw injector housing;

said index means including a carrier that engages a screw from below and raises said screw to said screw injector housing; and said index means being operated by a reciprocable motion of the screw gun towards and away from a substrate as screws are sequentially driven into said substrate.

15. The attachment of claim 14, further comprising:

said index means including stationary first and second guide plates disposed in transversely spaced apart, parallel relation to one another;

a first and second leading cam groove formed in a leading end of said first and second guide plates;

a first and second trailing cam groove formed in a trailing end of said first and second guide plates;

said carrier disposed between said first and second guide plates;

said carrier being formed of two parts, a first part being disposed contiguous to said first guide plate and a second part being disposed contiguous to said second guide plate;

a first cam follower pin having an outer end slideably disposed within said first leading cam groove and an inner end connected to said first part of said split carrier at a leading end of said carrier;

a second cam follower pin having an outer end slideably disposed within said second leading cam groove and an inner end connected to said second part of said carrier at said leading end of said carrier;

a third cam follower pin having an outer end slideably disposed within said first trailing cam groove and an inner end connected to said first part of said carrier at a trailing end of said carrier;

a fourth cam follower pin having an outer end slideably disposed within said second trailing cam groove and an inner end connected to said second part of said carrier at a trailing end of said carrier;

each of said cam grooves defining a preselected closed loop path of travel; and means for causing said cam follower pins and hence said carrier to traverse said closed loop path of travel one time for each screw driven into a substrate, said carrier sliding below and lifting one screw from said screw cartridge into the path of said bit driver for each traverse of said closed loop path of travel.

16. The attachment of claim 15, further comprising:

an inwardly turned flange formed in an upper and a lower edge of each of said first and second guide plates;

a first flat plunger plate slidingly housed by upper and lower flanges formed in said first guide plate and a second flat plunger plate slidingly housed by upper and lower flanges formed in said second guide plate;

a first leading lever, disposed inwardly of said first plunger plate, having an opening formed in its leading end for receiving said first cam follower pin;

a second leading lever, disposed inwardly of said second plunger plate, having an opening formed in its leading end for receiving said second cam follower pin;

a first trailing lever, disposed inwardly of said first plunger plate, having an opening formed in its leading end for receiving said third cam follower pin;

a second trailing lever, disposed inwardly of said second plunger plate, having an opening formed in its leading end for receiving said fourth cam follower pin;

a trailing end of said first leading lever being pivotally attached to said first plunger plate at a preselected point substantially mid-length thereof;

a trailing end of said second leading lever being pivotally attached to said second plunger plate at a preselected point substantially mid-length thereof;

a trailing end of said first trailing lever being pivotally attached to said first plunger plate near a trailing end thereof; and a trailing end of said second trailing lever being pivotally attached to said second plunger plate near a trailing end thereof;

whereby the leading end of said first lever traverses the path of travel defined by said first closed loop formed in the leading end of said first guide plate and the trailing end of said first lever traverses the path of travel defined by said third closed loop formed in the trailing end of said first guide plate as said first guide plate reciprocates between a forward and a rearward position;

whereby the leading end of said second lever traverses the path of travel defined by said second closed loop formed in the leading end of said second guide plate and the trailing end of said second lever traverses the path of travel defined by said fourth closed loop formed in the trailing end of said second guide plate as said plunger plate reciprocates between a forward and a rearward position;

whereby the leading end of said third lever traverses the path of travel defined by said third closed loop formed in the trailing end of said first guide plate as said first plunger plate is reciprocated between a forward and a rearward position; and whereby the leading end of said fourth lever traverses the path of travel defined by said fourth closed loop formed in the trailing end of said second guide plate as said second plunger plate is reciprocated between a forward and a rearward position.

17. The attachment of claim 16, further comprising:

a first coil spring for biasing said inner end of said first cam follower pin in a first preselected direction;

a second coil spring for biasing said inner end of said second cam follower pin in said first preselected direction;

a third coil spring for biasing said inner end of said third cam follower pin in said first preselected direction;

a fourth coil spring for biasing said inner end of said fourth cam follower pin in said first preselected direction;

a fifth coil spring for biasing said inner end of said first cam follower pin in a second preselected direction opposite to said first preselected direction;

a sixth coil spring for biasing said inner end of said second cam follower pin in said second preselected direction;

a seventh coil spring for biasing said inner end of said third cam follower pin in said second preselected direction;

an eighth coil spring for biasing said inner end of said fourth cam follower pin in said second preselected direction;

whereby each of said cam follower pins is urged toward said first direction when displaced toward said second direction and toward said second direction when displaced toward said first direction.

18. The attachment of claim 17, further comprising:

a first closure plate disposed between said first part of said split carrier and said first, third, fifth, and seventh coil springs;

a second closure plate disposed between said second part of said split carrier and said second, fourth, sixth, and eighth coil springs;

each of said closure plates having an outwardly turned upper and lower flange; and said first and third coil springs having respective first ends secured to said upper flange of said first closure plate;

said second and fourth coil springs having respective first ends secured to said upper flange of said second closure plate;

said fifth and seventh coil springs having respective second ends secured to said lower flange of said first closure plate; and said sixth and eighth coil springs having respective second ends secured to said lower flange of said second closure plate.

19. The attachment of claim 18, further comprising:

a first arcuate slot formed in a leading end of said first plunger plate;

a second arcuate slot formed in a leading end of said second plunger plate;

a third arcuate slot formed in said first plunger plate about mid-length thereof;

a fourth arcuate slot formed in said second plunger plate about mid-length thereof;

said first cam follower pin reciprocating within said first arcuate slot as said first plunger plate reciprocates;

said second cam follower pin reciprocating within said second arcuate slot as said second plunger plate reciprocates;

said third cam follower pin reciprocating within said third arcuate slot as said first plunger plate reciprocates; and said fourth cam follower pin reciprocating within said fourth arcuate slot as said second plunger plate reciprocates.

20. The attachment of claim 19, further comprising:

said first plunger plate having a tail piece that extends in a trailing direction;

an elongate slot formed in said tail piece of said first plunger plate;

said second plunger plate having a tail piece that extends in a trailing direction;

an elongate slot formed in said tail piece of said second plunger plate;

a first bracket secured to a leading end of said screw gun on a first side thereof;

a second bracket secured to a leading end of said screw gun on a second side thereof;

a first connector pin associated with said first bracket for engaging said elongate slot formed in said tail piece of said first plunger plate;

a second connector pin associated with said second bracket for engaging said elongate slot formed in said tail piece of said second plunger plate;

said first and second plunger plates being fully retracted when said first, second, third, and fourth cam follower pins are in respective fully retracted positions, said first and second connector pins engaging respective trailing ends of said first and second elongate slots, respectively, when said first and second plunger plates are fully retracted;

said first and second plunger plates being fully advanced when said first, second, third, and fourth cam follower pins are in respective fully advanced positions, said first and second connector pins engaging respective leading ends of said first and second elongate slots, respectively, when said first and second plunger plates are fully advanced.

* * * * *